US009163467B2

(12) United States Patent
Gaudette et al.

(10) Patent No.: US 9,163,467 B2
(45) Date of Patent: Oct. 20, 2015

(54) APPARATUS AND METHOD FOR GALVANICALLY REMOVING FROM OR DEPOSITING ONTO A DEVICE A METALLIC MATERIAL DOWNHOLE

(75) Inventors: Sean L. Gaudette, Katy, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 851 days.

(21) Appl. No.: 13/249,912

(22) Filed: Sep. 30, 2011

(65) Prior Publication Data

US 2013/0081814 A1 Apr. 4, 2013

(51) Int. Cl.

| | |
|---|---|
| ***E21B 43/08*** | (2006.01) |
| ***E21B 29/00*** | (2006.01) |
| ***E21B 23/00*** | (2006.01) |
| ***E21B 34/06*** | (2006.01) |
| ***E21B 34/14*** | (2006.01) |

(52) U.S. Cl.

CPC ..... *E21B 29/00* (2013.01); *E21B 23/00* (2013.01); *E21B 34/063* (2013.01); *E21B 34/14* (2013.01)

(58) Field of Classification Search

CPC ..... E21B 43/00; E21B 43/08; E21B 43/082; E21B 43/084; E21B 43/086; E21B 43/088

USPC ..... 166/376, 65.1, 277, 310

See application file for complete search history.

(56) References Cited

U.S. PATENT DOCUMENTS

| | | | | |
|---|---|---|---|---|
| 2,476,137 | A * | 7/1949 | Henri-Georges | 166/254.1 |
| 2,801,697 | A * | 8/1957 | Rohrback | 166/244.1 |
| 2,829,099 | A * | 4/1958 | Marsh | 204/196.15 |
| 2005/0236153 | A1 * | 10/2005 | Fouras et al. | 166/278 |
| 2008/0135249 | A1 * | 6/2008 | Fripp et al. | 166/285 |

* cited by examiner

*Primary Examiner* — Cathleen Hutchins
*Assistant Examiner* — Ronald Runyan
(74) *Attorney, Agent, or Firm* — Cantor Colburn LLP

(57) ABSTRACT

In one aspect, a method of performing a wellbore operation is disclosed that in one embodiment may include: deploying a device in the wellbore containing a conductive fluid, wherein the device is configured to disintegrate upon application of electrical current thereto; and applying current to the device in the wellbore using a tool to controllably disintegrate the device. In another aspect, an apparatus for use downhole is provided that in one embodiment may include a device placed at a selected location in a wellbore, wherein the device is made from a material that disintegrates when electric current is induced in to device and a tool placed proximate to the device configured to induce electric current into the device to cause the device to disintegrate.

24 Claims, 4 Drawing Sheets

APPARATUS AND METHOD FOR GALVANICALLY REMOVING FROM OR DEPOSITING ONTO A DEVICE A METALLIC MATERIAL DOWNHOLE

BACKGROUND

1. Field of the Disclosure

This disclosure relates generally to members and devices that may be disintegrated or dissolved after installation downhole.

2. Background of the Art

Oil wells (also referred to as wellbores or boreholes) are drilled in subsurface formations. Such wellbores are typically lined with a metallic liner referred to as casing. A production string is installed inside the casing to produce formation fluids (oil and gas) to the surface. Often, elements or devices are placed in the wellbore to perform a function and are removed after such devices have performed their intended functions. Such devices may include, for example, ball/ball seat assemblies, plugs and packers. Another example includes removing a section of the casing to form an opening through which a deviated borehole may be drilled. In some cases, to remove a device from the wellbore, drilling or milling tool is conveyed downhole to disintegrate the device. In other cases, such devices may be formed from a material that will corrode in the downhole environment and will thus disintegrate over a time period. In other cases, the device may be actively dissolved.

The disclosure herein provides devices or articles that may be galvanically removed or galvanically deposited with a metallic material downhole.

SUMMARY

In one aspect, a method of performing a wellbore operation is disclosed that in one embodiment may include: deploying a device in the wellbore containing a conductive fluid, wherein the device is configured to disintegrate upon application of electrical current thereto; and applying current to the device in the wellbore using a tool to controllably disintegrate the device.

In another aspect, an apparatus for use downhole is provided that in one embodiment may include a device placed at a selected location in a wellbore, wherein the device is made from a material that disintegrates when electric current is induced in to device and a tool placed proximate to the device configured to induce electric current into the device to cause the device to disintegrate.

Examples of various features of certain embodiments and methods have been summarized herein rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
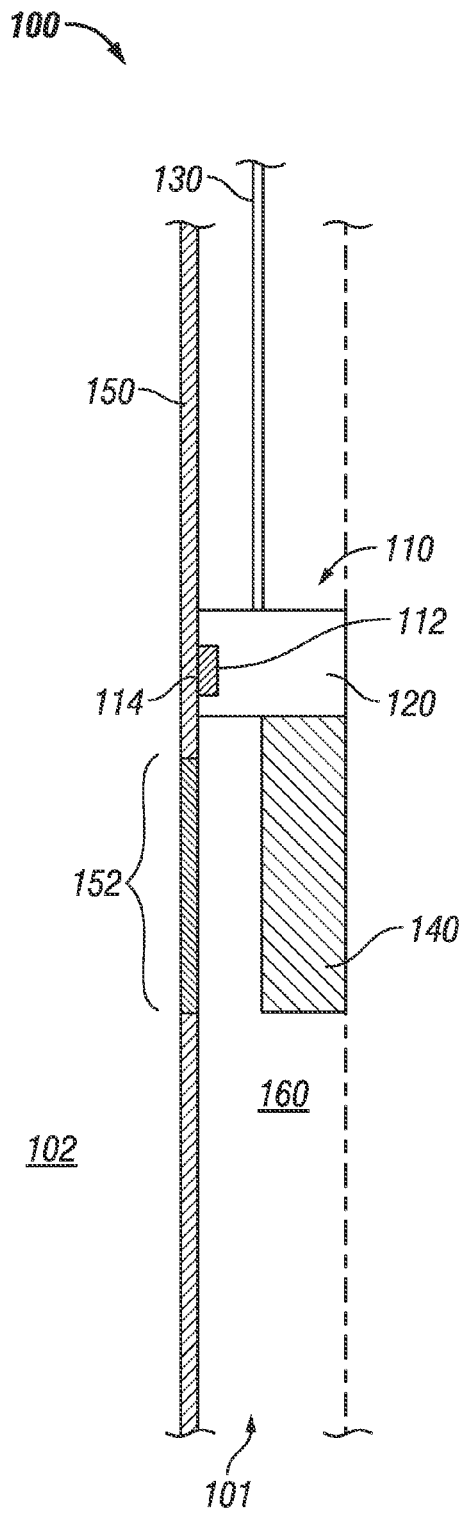
FIG. 1 is a line diagram of an electrical tool deployed in a wellbore configured to galvanically remove section of tubing downhole.

FIG. 1 is a line diagram of a wellbore system 100 in which an electrical tool 110 is deployed in a casing 150 (or device) placed inside a wellbore 101 formed in an earth formation 102, wherein the tool 110 is configured to remove a section 152 (or member) of the casing 150. The casing 150 is typically made from steel and in some cases may be made from aluminum. In the exemplary configuration shown in FIG. 1, section 152 of the casing 150 is formed from a material that will form a cathode for a galvanic process. Such materials, in aspects, may include, but are not limited to, nickel, copper, tin, zinc and chrome. To remove the section 152, an electrical tool 110 is conveyed into the casing 150 by a suitable conveying member, such as a wireline or coiled tubing 130. In one configuration, the tool 110 includes a contact or element 112 that couples to the casing 150 and a source 120 for supplying a selected or desired amount of current to the contact 112. The tool 110 includes an anode 140 that completes the electrical circuit between the cathode (section 152) and the anode 140. In aspects, the anode 140 may be made from any suitable anodic material, including, but not limited to, steel and aluminum.

To remove the section 152 from the casing 150, the tool 110 is conveyed into the wellbore 101 and set proximate to the section 152. The wellbore contains a conductive fluid 160 (such as brine) around the section 152 and the anode 140. The contact element 112 is extended to make a contact with the casing 150 at a contact point or location 114. Current at a suitable level (amperage) is supplied to the contact point 114. The current may be supplied from the surface by a suitable conductor in the conveying member 130. The flow of the current from the element 112 to the anode 140 causes the cathodic element 152 to deposit onto the anode 140 at a rate that is a function of the amount of the current and the brine concentration. To control the deposition rate of the section 152, the amount of the current and/or brine concentration may be altered. Generally, it is easier to alter and control the current supplied from the surface. Upon completion of the removal of the section 152, the contact element 114 is decoupled from the casing and the tool 110 is retrieved to the surface.

Figure 2:
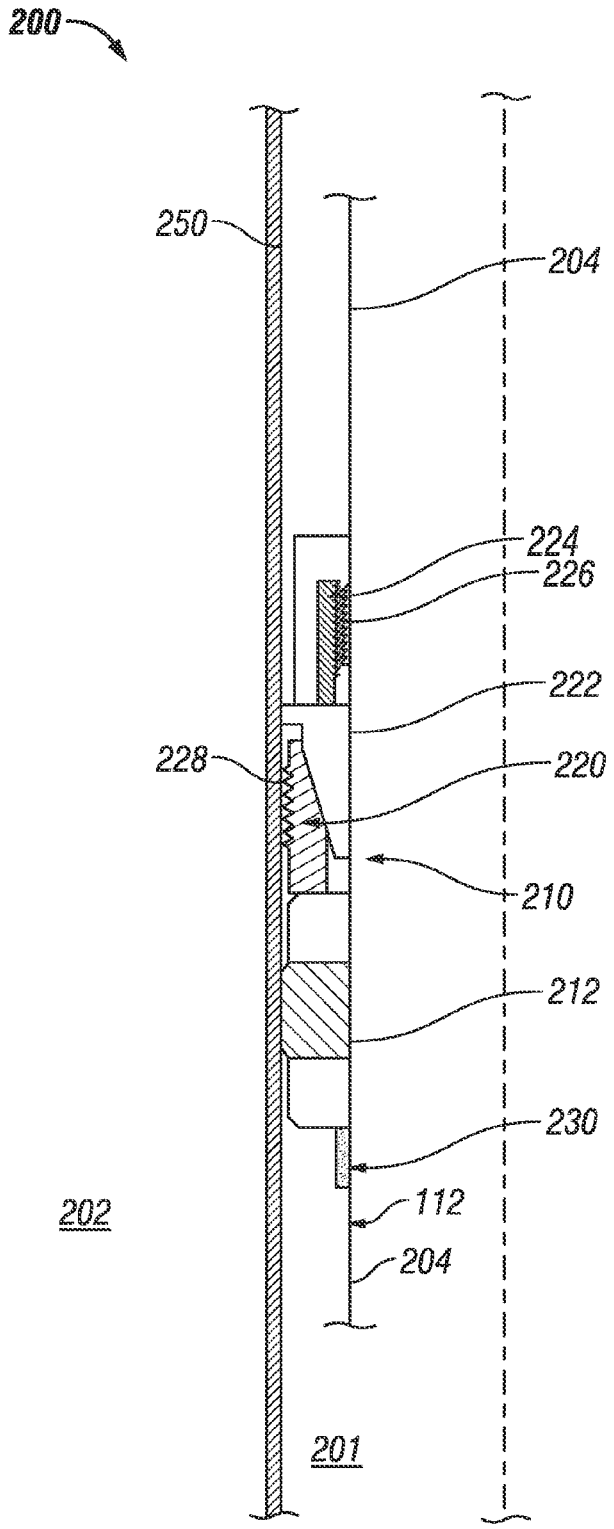
FIG. 2 is a line diagram of an exemplary packer anchored in a wellbore, wherein the packer includes a retainer member that may be galvanically removed to disengage the packer form the wellbore.

FIG. 2 is a line diagram of an exemplary wellbore system 200 that includes a wellbore 201 formed in an earth formation 202, wherein a packer 210 is anchored in a casing 250. The packer 210 is shown placed around a tubing 204. In aspects, the packer 210 includes a packing element or sealing 212 that radially extends from the tubing 204 to isolate the casing 250 above and below the packing element 212. The packer 210 further includes slips 220, cone 222 and a locking device 224, such as a body lock ring. The body lock ring 224 may include a ratchet mechanism 226 for moving and locking the cone 222 in the direction of the pacing element 212. A retaining member or retainer 230 attached to the tubing 204 retains the packing element 212 in its position on the tubing 204. To set the packer 210 in the casing 250, locking ring 224 is moved toward the cone 222 to cause the cone 222 to move the slips 220 radially outward toward the casing 250. The slips 220 include teeth 228 that engage with the casing and thus anchor the packer 210 in the casing 250. The packing element 212 is expanded to provide a seal between the casing 250 and the packing element 212, as shown in FIG. 2.

Still referring to FIG. 2, the retainer 230 is formed from a material that will form a cathode for a galvanic process. Such materials, in aspects, may include, but are not limited to, nickel, copper, tin, zinc and chrome. Referring now to FIGS. 1 and 2, to remove the retainer 230, an electrical tool, such as tool 110 (FIG. 1), is conveyed inside the tubing 204 by a suitable conveying member 130, such as a wireline or coiled tubing. The contact element or member 112 is then coupled to the tubing 204 to make an electrical connection with the tool 110. A selected or desired amount of current is then supplied to the contact 112, which creates a galvanic cell between the retainer (cathode) 230 and the anode 114 of the tool 110, which causes the cathodic material of the retainer 230 to deposit onto the anode 114 at a certain deposition rate. The deposition rate of the material of the retainer 230 may be controlled by controlling the current supply and/or altering the concentration of the brine 260 in the casing 202, as described above.

Figure 3:
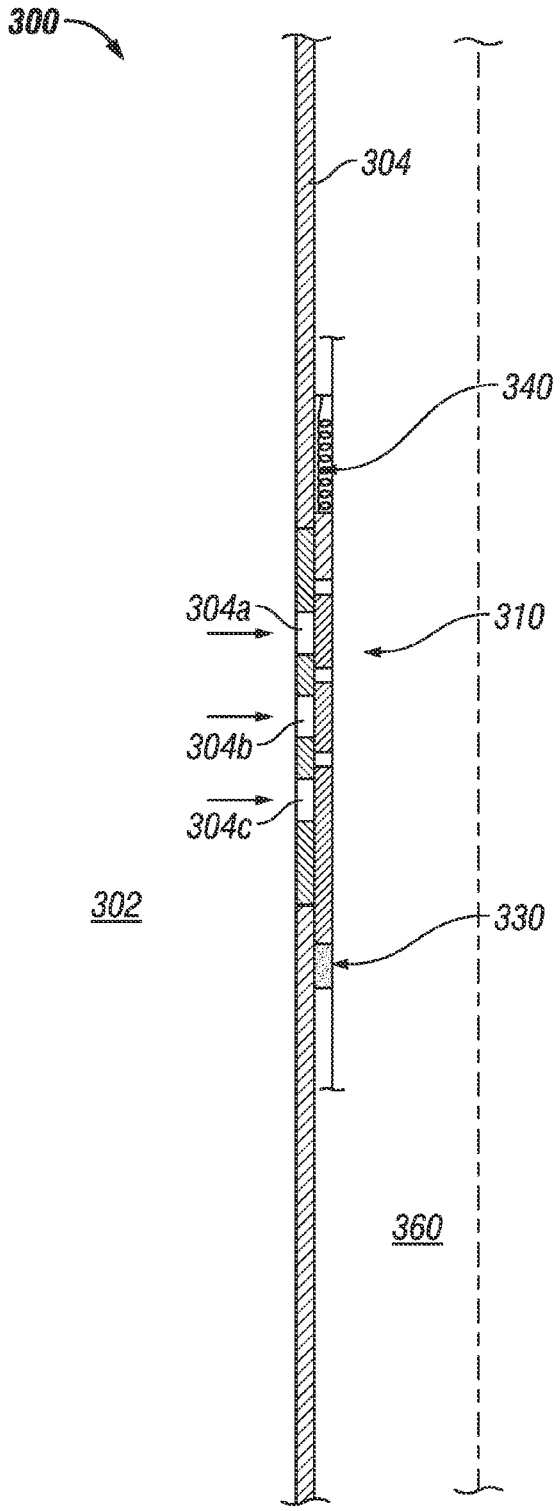
FIG. 3 is line diagram of a an exemplary sliding sleeve valve in a wellbore that may be activated by galvanically removing a retaining member associated with the sliding sleeve valve.

FIG. 3 is line diagram of a wellbore system 300 that includes a tubing 304 in a wellbore 301 formed in an earth formation 302. The tubing includes fluid openings 304*a*, 304*b* and 304*c* configured to allow fluid 306 from the formation 302 to flow into the tubing 304. A sliding sleeve valve 310 is placed in front of the openings 304*a*, 304*b* and 304*c*. The sliding sleeve valve includes a sliding or movable sleeve 320 that encloses the openings 304*a*, 304*b* and 304*c*. The sliding sleeve 320 is retained in its initial position (closed position shown in FIG. 3) by a retainer 330 configured to be galvanically removed. When the retainer 330 is removed, a biasing member 340 urges the sliding sleeve 320 to move in the direction of the retainer 330, which causes the openings 322*a*, 322*b* and 322*c* in the sleeve 320 to form a fluid path between the formation fluid 306 and the inside of the tubing 304.

Referring to FIGS. 1 and 3, the retainer 330 is made from a material that forms a cathode for a galvanic cell. Such materials, in aspects, may include, but are not limited to, nickel, copper, tin, zinc and chrome. To remove the retainer 330, an electrical tool, such as tool 110 (FIG. 1), is conveyed inside the tubing 304 by a suitable conveying member, such as a wireline or coiled tubing 130. The contact element or member 112 is then coupled to the tubing 304 to make an electrical connection. A selected or desired amount of current is then supplied to the contact element 112, which creates a galvanic cell between the retainer (cathode) 330 and the anode 114, which causes the retainer 330 material to deposit onto the anode 114 at a certain rate. The rate of deposition of the retainer material may be controller by altering the current supply and/or altering the concentration of the brine 360 in the tubing 304, as described above. When the retainer 320 is removed, a biasing member 340 causes the sleeve 320 to move in the direction of the retainer 320, thereby opening the ports 304*a*, 304*b* and 304*c* to provide fluid communication between the fluid 306 and the inside of the tubing 304.

Figure 4:
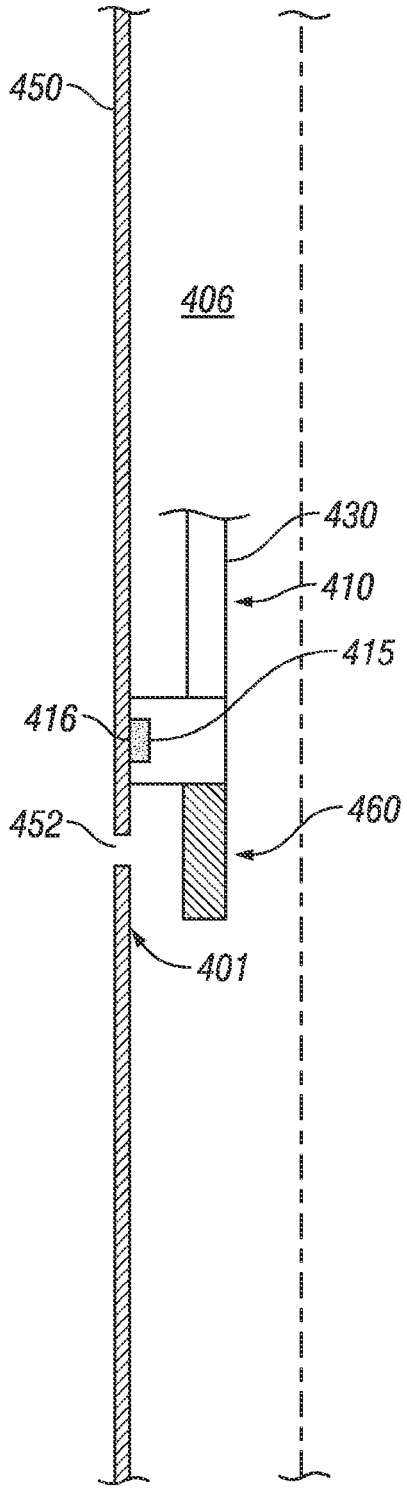
FIG. 4 is a line diagram of an electrical tool deployed in a wellbore configured to galvanically deposit a selected metallic material on a member or device placed in the wellbore.

FIG. 4 is a line diagram of an electrical tool 410 deployed in a wellbore 401 formed in an earth formation 402 that is configured to galvanically deposit a selected metallic material on a member or device in the wellbore 401. The method relating to the apparatus shown in FIG. 4 is essentially the inverse of the process utilized with respect to the apparatus of FIG. 1. In this case, a material is deposited from a cathodic member onto a member or device deployed in the wellbore instead of deposing a material from a device in the wellbore onto an anode. Such a method is useful in depositing a material on a member that has corroded or to fill in pits and gouges caused in metallic members by downhole environment, etc. As shown in FIG. 4 the electrical tool 410 is deployed in a casing 450 placed inside the wellbore 401, wherein the casing 450 includes a void 452 that is desired to be filled with a metallic material. The casing 450 is typically made from steel and in some cases from aluminum and thus can act as an anode for a galvanic process. In the exemplary configuration shown in FIG. 4, the electrical tool 410 is conveyed into the wellbore 401 by a conveying member 430, such as wireline or coiled tubing. The tool 410 includes a member 460 configured to act as a cathode and may be made from any suitable cathodic material, including, but not limited to, nickel, copper, tin, zinc and chrome. The tool 410 includes a contact member 415 that is coupled to the casing 450 at a location 416. To deposit the material of the member 460 on to the casing 450, current is supplied to the contact member 415 to form a galvanic cell between the casing 450 and the member 460 via brine 406 in the casing 450. The process is continued till the void 452 is filled.

Although the disclosure herein provides examples of certain devices that may be removed or on which metallic materials may be added or deposited downhole, the apparatus and methods described herein are applicable to any downhole device that is conducive to galvanic methods.

In view of the embodiments described herein, the disclosure herein in one aspect provides a method of performing a wellbore operation that includes deploying a device in the wellbore containing a conductive fluid and wherein the device is configured to disintegrate upon application of electrical current thereto and applying current to the device in the wellbore using a tool to controllably disintegrate the device. In one aspect, the tool may be conveyed into the wellbore by any suitable conveying member such as a wireline or coiled tubing. In one configuration the device forms a cathode of a galvanic sell and the tool includes an anode and a current generator. Applying the current creates a galvanic process that causes the material of the device to disintegrate and deposit onto the anode. The amount of the current may be controlled to control the rate of deposition. Typically, the conductive fluid is brine and the concentration of the brine determines, at least in part, the rate of deposition. In on aspect, the device may be a section of a tubular in the wellbore that is removed when the current is applied to the device and wherein the method may further include drilling a deviated borehole through the removed section of the tubing. The device may be any suitable metallic device, including, but not limited to, a bridge plug, fracture ball, sealing device, locking device, release ring and ball. The device may be made from any suitable metal, including, but not limited to, nickel, copper, zinc, tin and chrome. The anode may be formed of steel or aluminum. Another method of performing a wellbore operation may include determining location of a device deployed in the wellbore that is to be deposited with a selected material, wherein the device is configured to form cathode of a galvanic process, deploying a tool in the wellbore containing a current generator and an anode, and inducing current into the anode to cause deposition of the anode material onto the device in the wellbore.

In another aspect, the disclosure provides an apparatus for use downhole that in one embodiment includes a device placed at a selected location in a wellbore, wherein the device is made from a material that disintegrates when electric current is induced into device, and a tool proximate to the device configured to induce electric current into the device to cause the device to disintegrate. In one aspect, the device may be a section of a metallic member, such as casing, a retaining member of a packer, a retaining element of a sliding sleeve valve, etc. A cathodic element in the tool deposits a material onto the device in the wellbore when current is applied to the cathodic element by a current generator. The tool may be conveyed into the wellbore by wireline or coiled tubing. The tool also may include a circuit configured to control the amount of the induced current to control the rate of deposition. In one embodiment, the device is a one of a: tubing, bridge plug, fracture ball, sealing device, such as a packer, locking device, release ring, or a ball.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. A method of performing a wellbore operation, comprising:

deploying a tubular in a wellbore containing a conductive fluid, wherein an element of the tubular is configured to disintegrate upon application of electrical current thereto;

conveying a tool into the wellbore to a location of the element, with the conductive fluid between the element and the tool;

extending a contact from the tool to the tubular to form an electrical connection between the tool and the tubular; and applying current to the tubular in the wellbore using the tool to controllably disintegrate the element.

2. The method of claim 1, wherein the tool is conveyed into the wellbore by one of a wireline and coiled tubing.

3. The method of claim 1, wherein the tool includes a current generator and is a cathode of a galvanic process and the element is configured to form an anode of the galvanic process.

4. The method of claim 3, wherein supplying the current creates a galvanic cell between the element and the cathode in the tool that causes the material of the element to disintegrate and deposit onto the cathode.

5. The method of claim 3 further comprising controlling the current to control the disintegration of the element.

6. The method of claim 5, wherein the tubular is a casing and the element is a section of the casing.

7. The method of claim 3, wherein the anode is formed of a material selected from a group consisting of: aluminum; and steel.

8. The method of claim 1, wherein the conductive fluid is brine and the method further comprises selecting a concentration of the brine to control a rate of disintegration of the element.

9. The method of claim 1, wherein the element is selected from a group consisting of: a section of a casing; a sealing element; a plug; a locking device; a release ring; and a ball.

10. The method of claim 1, wherein the element includes a metallic element selected from a group consisting of: nickel; copper; zinc; tin; and chrome.

11. A method of performing a wellbore operation, comprising:

selecting a downhole section of a casing deployed in the wellbore that is to be deposited with a selected material, wherein the casing is configured to form a cathode of a galvanic process;

deploying a tool in the wellbore to a location of the downhole section, wherein the tool includes an anode formed from the selected material and is configured to supply current;

extending a contact from the tool to the casing at the location of the downhole section to form an electrical connection between the tool and the casing; and supplying the current to the anode by the tool to deposit the selected material on the downhole section of the casing.

12. The method of claim 11, wherein the downhole section of the casing is an area that includes one of a void, pit, gouge and crack.

13. An apparatus for use in a wellbore, comprising:

a tubular placed at a selected location in the wellbore, wherein an element is made from a material that disintegrates when electric current is induced into the element; and a tool conveyable in the wellbore to a location proximate to the element configured to induce electric current into the element to cause the element to disintegrate, wherein the tool includes a contact extendable from the tool to form an electrical connection between the tool and the tubular.

14. The apparatus of claim 13, wherein the tool includes a current generator and a cathode and the element forms an anode.

15. The apparatus of claim 13, wherein the tool is conveyed into the wellbore by one of a wireline and a tubing.

16. The apparatus of claim 13, wherein inducing the current into the element creates a galvanic cell between the element and the tool.

17. The apparatus of claim 13 further comprising a circuit configured to control an amount of the current to control a rate of disintegration of the element.

18. The apparatus of claim 13, wherein the tubular is a casing and the element forms a section of the casing.

19. The apparatus of claim 13, wherein the element is selected from a group consisting of a: section of a casing; sealing element; plug; locking device; release ring; and ball.

20. The apparatus of claim 13, wherein the element includes a metallic element selected from a group consisting of: nickel; copper; zinc; tin; and chrome.

21. The apparatus of claim 13, wherein the element is formed of a material selected from a group consisting of: aluminum; and steel.

22. A method of performing an operation in a wellbore, comprising;

placing a first metallic device in the wellbore;

conveying a second metallic device in the wellbore to a downhole location of the first metallic device wherein a conductive fluid remains between the first metallic device and the second metallic device; and extending a contact element from the second metallic device at the downhole location to form an electrical connection between the first metallic device and the second metallic device; and galvanically depositing at least a portion of the second metallic device onto the first metallic device in the wellbore.

23. The method of claim 22 further comprising configuring the first metallic device as a cathode of a galvanic cell and the second metallic device as an anode of the galvanic cell.

24. The method of claim 23 further comprising controlling supply of a current to the first metallic device to control a rate of deposition of the at least a portion of the second metallic device onto the first metallic device.

* * * * *